United States Patent [19]

Planchamp

[11] Patent Number: 4,865,645

[45] Date of Patent: Sep. 12, 1989

[54] NUCLEAR RADIATION METALLIC ABSORBER

[76] Inventor: Claude Planchamp, 4 rue Victor Hugo, F - 60500 Chantilly, France

[21] Appl. No.: 303,048

[22] Filed: Jan. 30, 1989

Related U.S. Application Data

[63] Continuation of Ser. No. 78,330, Jul. 27, 1987, abandoned.

[30] Foreign Application Priority Data

Jul. 30, 1986 [CH] Switzerland ..... 3054/86

[51] Int. Cl.[4] ..... C22C 29/14

[52] U.S. Cl. ..... 75/244; 252/478; 419/10; 420/469; 420/495; 420/590

[58] Field of Search ..... 252/478; 75/244; 419/10; 420/469, 495, 590

[56] References Cited

U.S. PATENT DOCUMENTS

| | | | |
|---|---|---|---|
| 4,227,928 | 10/1980 | Wang | 75/238 |
| 4,238,299 | 12/1980 | Wang | 204/16 |
| 4,249,998 | 2/1981 | Wilder | 204/16 |
| 4,253,917 | 3/1981 | Wang | 204/16 |
| 4,292,528 | 9/1981 | Shaffer | 250/506.1 |
| 4,395,464 | 7/1983 | Panchanathan et al. | 419/12 |
| 4,404,028 | 9/1983 | Panchanathan et al. | 75/244 |
| 4,437,890 | 3/1984 | Hayasaka et al. | 75/244 |
| 4,459,327 | 7/1984 | Wang | 427/183 |

FOREIGN PATENT DOCUMENTS 1219696 1/1971 United Kingdom .

*Primary Examiner*—Stephen J. Lechert, Jr.

*Attorney, Agent, or Firm*—Pollock, Vande Sande & Priddy

[57] ABSTRACT

The nuclear radiation metallic absorber contains a metallic copper alloy containing 0.05 to 50% of boron in weight, compared to the total alloy weight, preferably 0.05 to 10% boron in weight, compared to the total alloy weight. Moreover it may contain additional elements such as neutron absorbing elements, mechanical, physical and technological properties reinforcing elements, fibres or anti-corrosion elements.

It may more specifically be used for neutron and $\gamma$ and X radiation absorption.

9 Claims, No Drawings

NUCLEAR RADIATION METALLIC ABSORBER

This application is a continuation of application Ser. No. 078,330, filed 7/27/87 abandoned.

BACKGROUND OF THE INVENTION

The present invention concerns a nuclear radiation metallic absorber, more particularly an absorber containing a copper metallic alloy with 0.05 to 50% boron in weight compared to the total alloy weight. The ever increasing use of nuclear energy worldwide together with the development of nuclear techniques in general requires protections against the nuclear radiations (nuclear power stations, transportation and storing of radioactive waste, nuclear machines . . . ). It is therefore of prime importance and necessity to design and produce efficient and competitive radiation absorbers.

The absorption material is to comply with the following criterions:

First of all it must have specific nuclear properties: high neutron absorption cross section, low secondary radiation emission, and long duration stability against radiation.

It must have a high melting point to resist the heat released by absorption of radiation and more specifically by the neutron flux.

It must be a good heat conductor to facilitate cooling.

The residual heat must be within not too high limits (released as radiation after the stop).

Its mechanical resistance must be high enough.

It must resist corrosion by the coolant or the working atmosphere.

It must have a good heat and radiation resistance.

Its price must be competitive both with regard to the raw material and processing.

All elements are more or less good radiation absorbers, but those having the most outstanding neutron absorbing properties are: cadmium, boron, europium, hafnium, gadolinium, samarium and dysprosium.

Cadmium has the drawback of being highly toxic for the human body and its use is strictly prohibited in many countries. Moreover both its melting point (321° C.) and bviling temperature (761° C.) are very low, and its corrosion resistance in aqueous medium is very poor.

Europium and dysprosium although endowed with a big efficient absorbing section are seldom employed due to their very high price.

The absorbing properties of hafnium are much lower than those of boron with regard to thermal and epithermal neutrons, its price is high and its processing delicate due to its oxidizability.

Gadolinium shows in the thermal neutron spectrum the highest efficient absorbing section of all known absorbers. It can be seen, for example, that its efficient absorbing section is approximately 100 times higher than that of boron with regard to neutrons having an initial energy of $10^{-1}$ to $10^{-3}$ electron-volts. Unfortunately in the area of epithermal neutrons and slow neutrons (energy of 0.3 to $10^2$ electron-volts) the absorption properties are considerably below those of boron.

The gadolinium oxide has been used for many years in various nuclear installations where, when blended with the fuel, it plays the role of the moderator. But problems arise when gadolinium oxide is used for the production of radiation absorbers. Indeed the oxide which is generally available as powder must be mixed with other products which requires a very complex technology. When producing absorbers having a complex shape its poor mechanical properties result in critical and expensive processes. Moreover this oxide has a poor thermal conductivity and its absorption capacity is relatively reduced compared to that of elementary gadolinium.

Samarium has interesting neutron absorbing properties intermediate between those of boron and gadolinium with regard to thermal neutrons, and superior to boron and gadolinium with regard to intermediate and fast neutrons.

However compared to boron two areas of weak absorption remain, the first between 1 and 5 eV, the second between 30 and 40 eV. The most widespread absorber and best known for the criticity calculations is without any doubt boron which is used in various forms: elementary boron, borides (aluminum, chromium, hafnium, molybdenum, niobium, tantalum, titanium, tungsten, vanadium, zirconium . . . ), boron carbide, boron oxide $B_2O_3$, boron nitride, boric acid, borax etc. Processing of all the materials presently marketed is critical: the elementary boron has poor mechanical properties, and its thermal conductivity is low (32 W/m°K.). At high temperatures it is highly oxidizable and its corrosion resistance is poor. It must be inserted as a chemical component defined in various matrices and such composite material results in homogeneity and processing problems.

SUMMARY OF THE INVENTION

For all the above reasons and conscious of the interest in the element boron for absorption of nuclear radiation and more specifically neutrons, but conscious also of the problems generated by the presently marketed boron material, the applicant searched for and found means to alloy it with another metallic material to make a nuclear radiation absorber having the qualities set forth above.

PREFERRED EMBODIMENTS OF THE INVENTION

This new absorber is essentially characterized by the fact that it includes a copper metallic alloy, the boron content being comprised between 0.05 to 50% in weight related to the total alloy weight. Below 0.05% of boron weight the neutron absorbing effect is too weak and above 50% of boron content the processing is critical and the mechanical properties feeble. It is preferable to choose a range between 0.05% and 10% boron weight. Without being exclusive, that range presents the best compromise of technological properties and processing.

Two isotopes coexist in natural boron: boron 10 and boron 11. The natural boron 10 content in natural boron is 18.6% in weight (19.6% in atomic percentage) and only isotope 10 absorbs neutrons. On the market isotope 10 enriched boron is available (the percentage may go up to 96%) and both isotopes 10 and 11 have exactly the same chemical properties. This means that for the production of neutron barriers which is the subject of the present invention both enriched boron (at any concentration) and natural boron may be used.

In these copper boron alloys the absorption properties are defined by the relative mass of natural boron and more specially by the presence of boron 10 in the alloy. Indeed the absorption capacity of an element is defined by its efficient neutron absorbing section, expressed in BARN. From the efficient section $\nu$ an absorption coefficient $\mu$ can be found through the relation $$\mu = \rho N \nu / A$$

where $\mu$ is shown in $cm^{-1}$, $\rho$ is the density of the material, expressed in $g/cm^3$, A is the atomic mass in g, $\nu$ is the neutron absorbing cross-section in $cm^2$, and, N is Avogadro's number For an element including several stable isotopes of relative dilution the following formula is applied:

$$\mu = \rho \frac{N}{A} \sum_i \nu i \, Di$$

To calculate the absorption coefficient of an alloy all its constituents are to be taken into consideration and the following formula is to be used:

$$\mu_{alloy} = \rho N \sum_i \frac{\nu i \nu i}{Ai}$$

where $\rho$=density of the alloy, ci=weight concentration of the element i in the alloy, $\nu$i=cross-section of the element i, Ai=atomic mass of the element i.

In the case of the copper-boron alloys the absorption coefficient is in direct accordance with the weight percentage of boron 10.

In practice that percentage is defined according to the researched for absorption properties.

Coming back to the copper-boron alloys it is to be indicated that the copper may be used pure or combined with any other additive elements to reinforce the mechanical properties of the absorbers or change their technological properties (easy processing, corrosion resistance, machinability, weldability). Also among all additive elements other than copper and boron additional neutron absorbing elements such as gadolinium, samarium, europium, hafnium, cadmium, lithium, dysprosium may be introduced or fibres may be inserted (alumina, silicon carbide, boron, carbon).

In opposition to the majority of the boron products presently available the copper-boron alloys are easy to process in at least one moulding method, i.e., sand, gravity die, low or high pressure casting, hot or cold rolling, extrusion, forging, vacuum forming.

Those alloys have perfectly homogeneous structures with very regular neutron absorbing cross-sections. The density of the blends will vary according to the boron content. The following Table 1 shows estimated values of the specific gravity for various compositions:

TABLE 1

| Specific gravity of various Cu-B alloys | | |
|---|---|---|
| Alloy | weight boron percentage | density |
| Cu B | 2 | 8.8 |
| Cu B | 10 | 8.3 |

With regard to the thermal conductivity it will considerably vary according to the alloys chosen for the production of the absorbers: the thermal conductivity of pure copper is 394 W/m° K., the conductivity of boron is 32 W/m° K. The thermal conductivity of the copper will be influenced by the boron content and by the other additive constituents introduced in view of possibly improving the mechanical, technological or absorbing properties. The property of thermal conductivity is important and will considerably influence the choice of the optimal absorbing material as any radiation absorption (and more specially neutron absorption) is accompanied by release of heat which must be transferred as quickly as possible from the hot areas to the cold areas. It is to be noted that from this standpoint the copper matrix is a particularly good choice.

The atomic mass of copper is high (63.5 g/mol) and the copper-boron absorbers are particularly efficient against the $\gamma$ and X radiation, boron being a good neutron absorber although it poorly absorbs the other radiation.

The eutectic composition of the Cu-B alloys melts at 1013° C. This high temperature allows the alloys to withstand, without problems, the heat released by the absorption of neutrons and other radiation. The solidification range varies according to the composition, as shown in Table 2.

TABLE 2

| Solidification range of a few Cu-B mixtures (weight percentage) | | |
|---|---|---|
| Alloy | Solidification start °C. | Solidification end °C. |
| Cu-B 1.5 | 1053 | 1013 |
| Cu-B 2.6 | eutectic composition 1013 | |
| Cu-B 10 | 1350 | 1013 |

Generally speaking the corrosion resistance is not, or is only little affected by the presence of boron up to 10% in weight, and the corrosion properties will essentially depend on the copper matrix employed. The corrosion resistance of the copper matrix is improved by the addition of elements such as chromium, nickel, aluminium, tin etc.

There may occur problems with the copper matrix at high temperature, copper oxidizing from 250° C. and the copper oxide being soluble in copper. At high temperatures it is therefore necessary to introduce an additional additive element intended to confer a good oxidation resistance to the matrix. It may be chromium, nickel, or aluminium for example.

At low temperatures the copper-boron alloys do not show any signs of fatigue.

As already mentioned in the introduction the radiation absorbers must have good mechanical properties which are to be as stable as possible at high temperatures. A good balance is to be found between the values of mechanical resistance, thermal conductivity, nuclear properties and processing possibilities. Table 3 shows as an example the mechanical properties of an alloy with 0.5% chromium and 2% boron.

TABLE 3

| Mechanical properties of the alloy Cu-2% B-0.5% Cr cast or hammered | | | |
|---|---|---|---|
| Alloy condition | UTS MPA | YS 0.2 MPA | El. % |
| Cast, condition T4 | 250 | 100 | 25 |
| Cast, condition T6 | 350 | 280 | 15 |
| Hammered, condition T4 | 250 | 200 | 25 |
| Hammered, condition T6 | 450 | 300 | 12 |

There are no special problems with the machining and welding of Cu-B alloys whether alloyed or not with other conventional elements. All techniques currently employed for this type of metallic matrix are suitable.

As application examples one may name: nuclear waste transportation and storing baskets, nuclear reactor fuel element storing pool racks, armor plating decontamination installations, nuclear fall-out shelters and nuclear protection in general, nuclear reactor elements, armor plating of control equipment using radiation and radioactive sources, armor plating of electronic boxes etc.

Preparation of a Cu—1.2% B—0.6% CR alloy nuclear radiation absorber

Boron being both a highly reactive metal with regard to the oxygen in the air and a highly reducing metal, great caution must prevail during the preparation of the alloy. One among other possibilities is to use metallic boron in lumps, pure copper in ingots and pure chromium in grains. The lumps of metallic boron (120 grams) are put into a graphite crucible, and the chrome (60 grams) and the copper (9820 grams) are added. The crucible is then placed in an electric furnace or in an induction furnace. One puts on top of the copper lumps a graphite biscuit the diameter of which must be smaller than the inside diameter of the crucible.

The mixture is primary vacuum heated at 1–2 millibars up to 600° C. during one hour in order to dry the whole enclosure and the elements introduced into the crucible. While maintaining a 1–2 millibar vacuum the temperature is increased up to 1220° C. When the copper is molten the solid boron lumps, the density of which is much lower, will come up to the surface of the liquid copper bath.

Thanks to the graphite biscuit floating on the liquid bath the metallic boron lumps will remain immersed and will be dissolved more quickly in the liquid copper. The temperature of 1220° C. is to be maintained during 3 to 4 hours to achieve the complete dissolution of the boron.

Then the furnace is opened, the graphite biscuit is withdrawn, the bath surface is skimmed and the content of the crucible is poured into a metallic mould, a sand mould, a ceramic mould or an ingot mould. The castability of the obtained alloys is remarkable.

Once the pre-profile achieved, either through moulding or making an ingot the radiation absorber is to be shaped through normal metal transformation techniques such as machining, forging, rolling, and extruding. The initial design of both the profile and the absorber thickness are achieved by the design office entrusted with the criticality calculations and the design of the nuclear machine in which the absorber is to be inserted.

What is claimed is:

1. A nuclear radiation absorber comprising metallic copper and metallic boron made by providing a mixture comprising metallic copper and about 0.05 to about 50% boron by weight, heating said mixture to a temperature at which metallic copper melts and retaining the resulting mixture at a temperature sufficiently high to retain copper in the molten state for a period of time sufficient to dissolve substantially all said metallic boron in the molten copper.

2. A process of making a nuclear radiation absorber comprising a metallic copper matrix containing metallic boron, said process comprising the steps of providing a mixture comprising metallic copper and 0.05 to about 50% by weight metallic boron, heating said mixture to a temperature at which metallic copper melts, and retaining the resulting mixture at a temperature sufficiently high to retain copper in the molten state for a period of time sufficient for substantially all the metallic boron to dissolve in the molten copper.

3. A process according to claim 2 wherein the mixture of copper and boron is heated to a temperature of at least about 1220° C. and maintains at a temperature at least about 1220° C. for a period of at least about 3 hours.

4. A process according to claim 2 wherein said mixture contains metallic boron in a concentration from about 0.05 to about 10% by weight.

5. A process according to claim 4 wherein said mixture contains from about 1.2 to about 2% metallic boron, from about 0.5 to about 0.6% metallic chromium, and the remainder metallic copper.

6. A process according to claim 5 wherein said mixture contains about 1.2% metallic boron, 0.6% metallic chromium, and the remainder metallic copper.

7. A process according to claim 5 wherein said mixture contains about 2% metallic boron, about 0.5% metallic chromium and the remainder metallic copper.

8. A process according to claim 2 wherein means are provided to keep boron particles immersed in the molten copper until said particles are dissolved.

9. A process according to claim 8 wherein said melting of copper and dissolution of boron in the molten copper are carried out in a vacuum.

* * * * *